US005580054A

United States Patent [19]

Shneifer

[11] Patent Number: 5,580,054

[45] Date of Patent: Dec. 3, 1996

[54] LOTTERY-TYPE GAME, AND A METHOD OF PLAYING THE SAME

[76] Inventor: Vitaly Shneifer, ul.Krasnoarmeiskaya 80, Rostov-Na-Donu, Russian Federation

[21] Appl. No.: 497,069

[22] Filed: Jun. 30, 1995

[51] Int. Cl.[6] ..... A63F 3/06

[52] U.S. Cl. ..... 273/138.1; 273/139; 273/157 R; 273/296

[58] Field of Search ..... 273/138 R, 157 R, 273/139, 282.2, 296; 446/147, 901

[56] References Cited

U.S. PATENT DOCUMENTS 1,570,906 1/1926 McCord ..... 273/157 R 4,714,275 12/1987 Engel et al. ..... 446/147

4,756,533 7/1988 Hopkins et al. ..... 273/157 R

*Primary Examiner*—Benjamin H. Layno

*Attorney, Agent, or Firm*—Ilya Zborovsky

[57] ABSTRACT

A lottery-type game has a plurality of carriers each having a single basic image of an object, a plurality of individual parts which are detachable from the basic image and attachable to the basic image so as to form a complete object with the basic image and all the parts, each of the carriers has at least one of the parts, so that when a player obtains a sufficient number of the carriers, he can detach the parts from the carriers and attach all parts to one of the carriers, and when all parts constituting the object are attached on the basic image on the one of the carriers, a player becomes a winner.

8 Claims, 2 Drawing Sheets

| PART / MODEL | WHEEL | DOOR | | |
|---|---|---|---|---|
| FORD | 11 | 1·2 | | |
| ---- | 21 | 12 | | |
| | | | | |
| | | | | |

FIG. 4

| PART / MODEL | WHEEL | DOOR | | |
|---|---|---|---|---|
| FORD | 11 | 12 | | |
| ---- | 21 | 12 | | |
| | | | | |
| | | | | |

CAR LOTTERY BULLETIN

FOR SALE : FORD MUSTANG WHEEL

FIG. 5

LOTTERY-TYPE GAME, AND A METHOD OF PLAYING THE SAME

BACKGROUND OF THE INVENTION

The present invention relates to a lottery-type game and a method of playing the same.

Lottery-type games are generally known in the art. In conventional lotteries a plurality of tickets are printed and distributed, then a draw is carried out, and a person who guessed the winning numbers by for example crossing corresponding numbers on the lottery ticket is declared a winner. There are instant lottery type games, in which a lottery ticket has an area to be acted upon by a player, for example scratched by a player, so as to expose a winning number or a combination, and a person who purchased the ticket with the winning number of combination is declared a winner. It is believed that the lottery-type games can be further improved, in particular, in order to increase attractiveness and also creativeness of playing the game.

SUMMARY OF THE INVENTION

Accordingly, it is an object of the present invention to provide a new lottery-type game and a method of playing the same which is a further improvement of the existing lottery-type games and playing methods.

In keeping with these objects and with others which will become apparent hereinafter, one feature of the present invention resides, briefly stated, in a lottery-type game which has a plurality of carriers each having an image of an object, and at least one removable and reattachable part of the object provided on each of the carriers so that the parts of different carriers are different from one another, and it is possible upon obtaining a plurality of the carriers to accumulate such number of the parts that the parts can be attached to the image and form the object as a finished article.

In accordance with the inventive method, the above described carriers are produced and distributed among potential players, the potential players accumulate the carriers with the different parts, remove parts from the carriers and apply them to one carrier in an attempt to produce a finished object, and the winner is a person who has produced the finished object.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a view showing a reverse side of a typical carrier of the inventive lottery-type game; and FIG. 5 is a view showing a trade bulletin for exchanging of the parts of the inventive lottery-type game.

DESCRIPTION OF THE PREFERRED EMBODIMENTS

Figure 1:
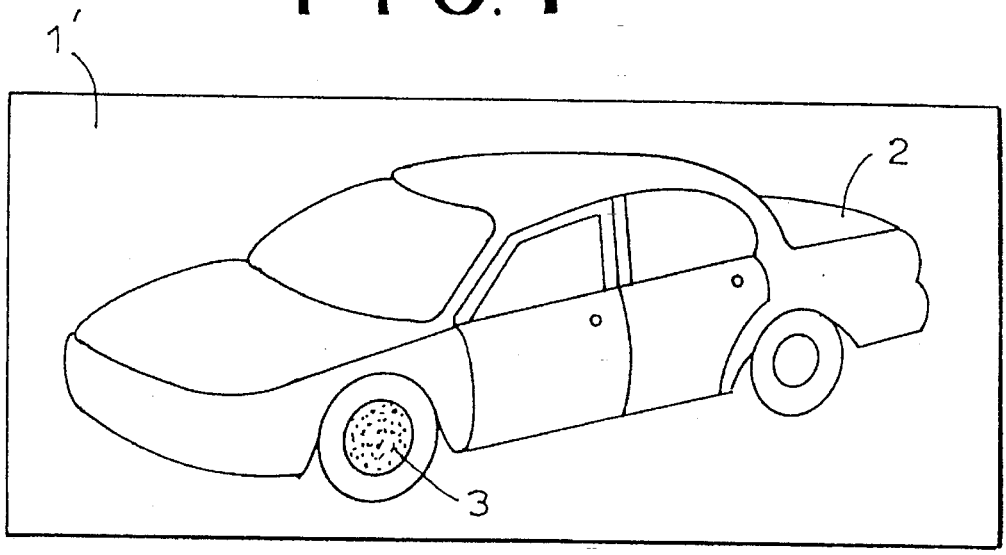
FIGS. 1–3 are views showing three carriers of the inventive lottery-type game, each provided with a basic image and all provided with different parts attached to, detachable and reattachable to the basic image.
Figure 2:
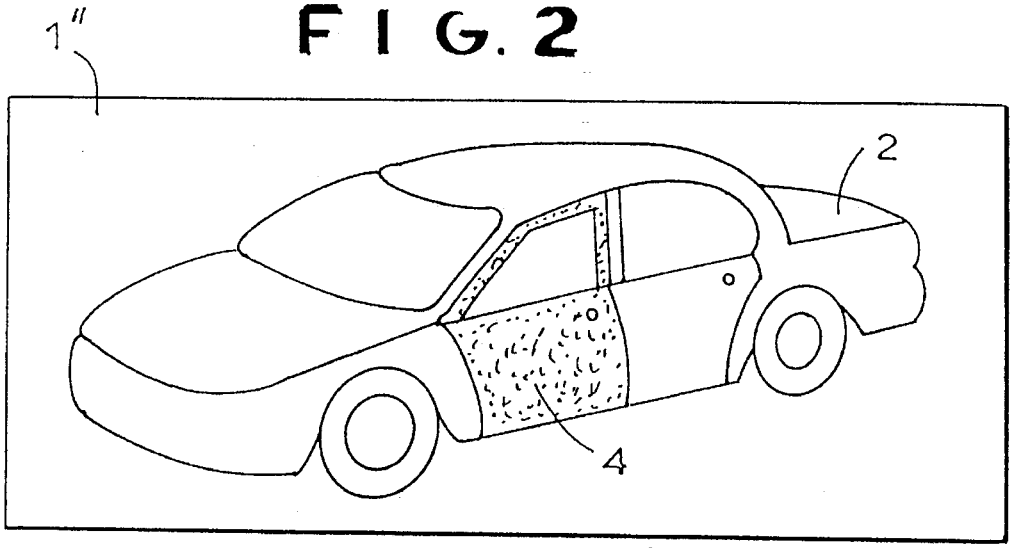
Figure 3:
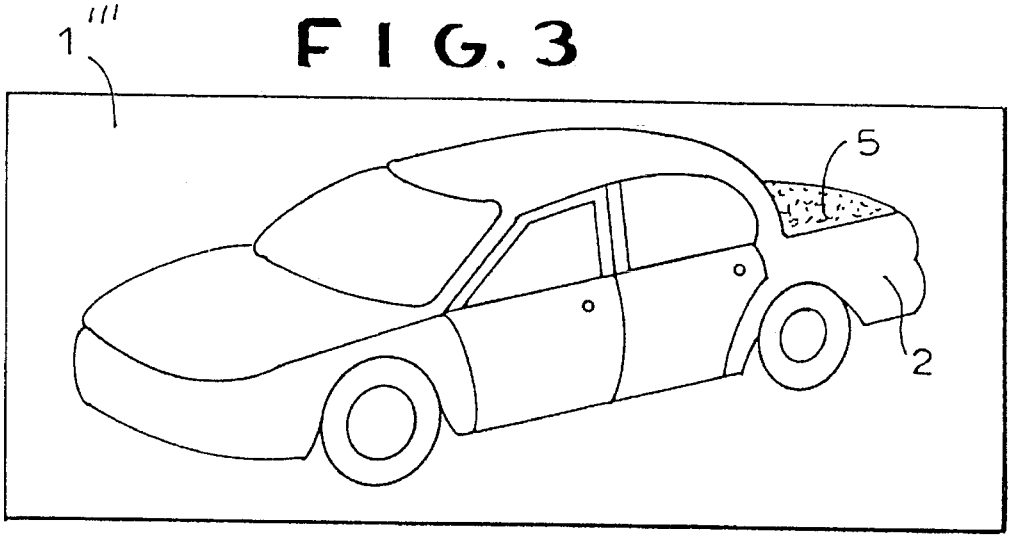

A lottery-type game in accordance with the present invention has a plurality of carriers which are identified in the drawings with reference numerals 1', 1", and 1'''. Each carrier has a basic image which is identified with reference numeral 2. The basic images on all carriers shown in FIGS. 1–3 are identical and represent a schematic image of a car. It is to be understood that the basic image of any other object can be provided as well, such as for example a house, a plane, a street, etc.

Each carrier has at least one part which is removable and again reattachable. In FIG. 1, the removable and reattachable part is a front wheel 3. In FIG. 2, the removable and reattachable part is the side door 4. In FIG. 3 the removable and reattachable part is a trunk cover 5. The removable and reattachable parts can be formed for example as regular stickers which have a base and an adhesive layer formed so that the part is first attached to the basic image 2, it can be then removed by a player, and reattached again to the other basic image 2. In the produced plurality of carriers, there are carriers which together contain all parts 3, 4, 5, etc., required to assemble a complete finished car.

For playing the lottery-type game in accordance with the present invention, a plurality of carriers are printed and formed as described hereinabove. They are distributed or sold to a plurality of players. A player who obtained several carriers keeps one of the carriers with one part attached to it, removes other parts from other carriers which he obtained, and attaches the parts to the first carrier in an attempt to produce a finished car. If after obtaining a certain number of carriers the player can attach to the basic image 2 all parts so as to form the finished car, he wins the lottery-type game. The carrier with the completely finished car can be submitted to a central authority, verified, and a winner can be announced with corresponding prizes of a predetermined type.

In accordance with a further feature of the present invention, the objects can be of different types as well. For example for the cars, the carriers can have the same basic image, but the parts can be from different cars, such as for example from Ford, from Chrysler, from Pontiac, etc. The parts can be numbered, and on a reverse side of the carrier there can be a table showing the models of the cars and the parts to the corresponding models with numbers assigned to a part of a corresponding model. The player's objective is to produce a finished car of a corresponding model, for example a finished Ford Mustang, or a finished Pontiac Boneville, etc. The numbers are provided both on the reverse side of each carrier, and on the parts, so as to facilitate the production of the corresponding model.

In accordance with still a further feature of the present invention, the game is provided with a bulletin sheet. If the player has parts for one model, and has other parts which are acceptable only from another model, he can fill in the bulletin sheet listing the parts of the other models which he does not need to produce the car of the model he has selected, and a central authority then can publish a bulletin based on the bulletin sheets submitted by the players, proposing to exchange or to trade the unneeded parts. The players can obtain the bulletins and get or purchase the parts from other players.

In accordance with another modification, the area of the carriers which is provided with the basic image can be also provided with an adhesive for reattaching the parts. Furthermore, in accordance with a further modification, in the game set there can be only one carrier provided with the basic image of an object and with one part removably attached to it, while other remaining parts of the same object can be provided not on further carriers with the basic images, but instead distributed as individual parts, for example contained in bags, etc.

It will be understood that each of the elements described above, or two or more together, may also find a useful application in other types of constructions and methods differing from the types described above.

While the invention has been illustrated and described as embodied in a lottery-type game and a method of playing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lottery-type game, comprising a plurality of carriers each having a single basic image of an object; a plurality of individual parts which are detachable from the basic image and attachable to the basic image so as to form a complete object with the basic image and all the parts, each of said carriers has at least one of the parts, so that when a player obtains a sufficient number of the carriers, he can detach the parts from the carriers and attach all parts to one of the carriers, and when all parts constituting the object are attached on the basic image on the one of the carriers, a player becomes a winner, said parts being provided with numbers, and each of said carriers having a reverse side provided with a table with numbers corresponding to the numbers of said parts, so that by matching the number of a respective one of the part with a number in said table, a player can determine whether said respective one of said parts matches with a respective one of said carriers.

2. A lottery-type game as defined in claim 1, wherein said individual parts are formed as stickers with an adhesive layer.

3. A lottery-type game as defined in claim 1, wherein said plurality of carriers includes a first group of carriers with the basic image of an object of one type, and a second group of carriers with the basic image of the object of another type, said individual parts including parts corresponding to the basic image of one type, and parts corresponding to the basic image of another type, so that the player by attaching corresponding parts can produce on the carrier either the object of one type or the object of the other type, each of said carrier having a reverse side provided with a table listing types of the objects and the names of the parts, and numbers attached to each part of each type of the object, and each of said parts being provided with a corresponding number.

4. A lottery-type game as defined in claim 3; and further comprising a bulletin sheet on which a player can list the parts obtained by him but corresponding to the type of the object which he is not willing to assemble and is willing to exchange with another player.

5. A method of playing a lottery-type game, comprising the steps of providing a plurality of carriers, each having a single basic image of an object; providing a plurality of individual parts which are detachable from the basic image and attachable to the basic image so as to form a complete object with the basic image and all the parts, each of said carriers has at least one of the parts; and when a player obtains a sufficient number of the carriers, detaching the parts from the carriers and attaching all parts to one of the carriers, and when all parts constituting the object are attached on the basic image on the one of the carriers, a player becomes a winner, said parts being provided with numbers, and each of said carriers having a reverse side provided with a table with numbers corresponding to the numbers of said parts, so that by matching the number of a respective one of the part with a number in said table, a player can determine whether said respective one of said parts matches with a respective one of said carriers.

6. A method as defined in claim 5, wherein providing a plurality of individual parts includes forming said individual parts as stickers with an adhesive layer.

7. A method as defined in claim 5, wherein providing said plurality of carriers includes providing a first group of carriers with the basic image of an object of one type, and a second group of carriers with the basic image of the object of another type, said providing individual parts including providing parts corresponding to the basic image of one type, and parts corresponding to the basic image of another type, so that the player by attaching corresponding parts can produce on the carrier either the object of one type or the object of the other type, each of said carrier having a reverse side provided with a table listing types of the objects and the names of the parts, and numbers attached to each part of each type of the object, and each of said parts being provided with a corresponding number.

8. A method as defined in claim 7; and further comprising providing a bulletin sheet on which a player can list the parts obtained by him but corresponding to the type of the object which he is not willing to assemble and is willing to exchange with another player.

* * * * *

UNITED STATES PATENT AND TRADEMARK OFFICE

CERTIFICATE OF CORRECTION

PATENT NO. : 5,580,054
DATED : December 3, 1996
INVENTOR(S) : Vitaly Shneider

It is certified that error appears in the above-indentified patent and that said Letters Patent is hereby corrected as shown below:

On the title page, item [76] Inventor:
" Vitaly Shneifer" should read --Vitaly Shneider--.

Signed and Sealed this

Seventh Day of January, 1997

Bruce Lehman

*Attest:*

BRUCE LEHMAN

*Attesting Officer*

*Commissioner of Patents and Trademarks*